US008831474B2

(12) United States Patent
Joo et al.

(10) Patent No.: US 8,831,474 B2
(45) Date of Patent: Sep. 9, 2014

(54) DEVELOPING DEVICE AND IMAGE FORMING APPARATUS INCLUDING THE SAME

(75) Inventors: Jong-hwa Joo, Seoul (KR); In-cheol Jeon, Yongin-si (KR); Woong-yong Choi, Yongin-si (KR); Ki-jae Do, Suwon-si (KR); Jun-ho Kim, Hwaseong-si (KR); Sang-jin Park, Hwaseong-si (KR); Jong-uk Kim, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 400 days.

(21) Appl. No.: 13/067,516

(22) Filed: Jun. 6, 2011

(65) Prior Publication Data

US 2012/0163879 A1 Jun. 28, 2012

(30) Foreign Application Priority Data

Dec. 23, 2010 (KR) ..... 10-2010-0133727

(51) Int. Cl.
*G03G 21/16* (2006.01)
*G03G 21/18* (2006.01)

(52) U.S. Cl.
CPC ..... *G03G 21/1857* (2013.01); *G03G 21/186* (2013.01)
USPC ..... 399/111; 399/167; 399/279; 411/356; 464/182; 403/1; 403/109.1; 403/109.2; 403/109.3; 403/109.8

(58) Field of Classification Search
USPC ..... 399/111, 167, 279; 411/356; 464/182; 403/383, 1, 109.1–109.3, 109.8
See application file for complete search history.

(56) References Cited

U.S. PATENT DOCUMENTS

| | | | | |
|---|---|---|---|---|
| 2005/0276634 | A1* | 12/2005 | Jeon | 399/167 |
| 2006/0291906 | A1* | 12/2006 | Lee | 399/223 |
| 2008/0124129 | A1* | 5/2008 | Lee | 399/167 |
| 2008/0152388 | A1* | 6/2008 | Ueno et al. | 399/167 |
| 2010/0054822 | A1* | 3/2010 | Nishikawa et al. | 399/286 |

FOREIGN PATENT DOCUMENTS

JP 05188810 A * 7/1993

* cited by examiner

*Primary Examiner* — Ryan Walsh
(74) *Attorney, Agent, or Firm* — Staas & Halsey LLP

(57) ABSTRACT

A developing roller including a housing containing toner; and a developing roller installed in the housing and supplies the toner to an electrostatic latent image formed on a photoconductor, the developing roller including a cylindrical unit in the form of a hollow pipe and a power transmission unit connected to one end of the cylindrical unit and connected to a power transmission member for rotating the developing roller. Both ends of the cylindrical unit are supported by the housing and the power transmission unit is not restricted by the housing. Both ends of the cylindrical unit are supported by the housing and the power transmission unit is not restricted by the housing.

12 Claims, 4 Drawing Sheets

DEVELOPING DEVICE AND IMAGE FORMING APPARATUS INCLUDING THE SAME

CROSS-REFERENCE TO RELATED APPLICATIONS

This application claims the benefit of Korean Patent Application No. 10-2010-0133727, filed on Dec. 23, 2010, in the Korean Intellectual Property Office, the disclosure of which is incorporated herein in its entirety by reference.

BACKGROUND

1. Field

The present general inventive concept relates to a developing device including a developing roller for applying toner to a photoconductor and for developing and an electrophotographic image forming apparatus including the developing device.

2. Description of the Related Art

Electrophotographic image forming apparatuses irradiate light modulated in response to image information to a photoconductor and form an electrostatic latent image on a surface of the photoconductor. Also, the electrophotographic image forming apparatuses supply toner to the electrostatic latent image so as to develop as a visible toner image and transfer and fix the toner image to a recording medium, thereby printing an image on the recording medium. The electrophotographic image forming apparatus includes a developing device containing toner.

Toner may be provided as in a cartridge form including the developing roller and the cartridge is denoted as a 'developing device'. The developing device is removed from an image forming apparatus when toner contained in the developing device is all used and a new developing device is mounted to the image forming apparatus.

SUMMARY

The present general inventive concept provides a developing device that may stably support a developing roller, and an image forming apparatus including the developing device.

According to an aspect of the present general inventive concept, there is provided a developing device including: a housing containing toner; and a developing roller installed in the housing and supplies the toner to an electrostatic latent image formed on a photoconductor, the developing roller including a cylindrical unit in the form of a hollow pipe and a power transmission unit connected to one end of the cylindrical unit and connected to a power transmission member for rotating the developing roller, wherein both ends of the cylindrical unit are supported by the housing and the power transmission unit is not restricted by the housing.

One end of the cylindrical unit may include a connection hole, and the power transmission unit may include an insertion unit having a diameter smaller than a diameter of an inner side of the cylindrical unit and inserted into the inner side, an extension unit extended from the insertion unit and combined with the power transmission member, and a connection projection inserted into the connection hole so that the power transmission unit rotates with the cylindrical unit.

The developing device may further include a bearing member interposed between the housing and the both ends of the cylindrical unit.

The bearing member may support the inner side of the cylindrical unit. The bearing member may support an outer side of the cylindrical unit.

According to another aspect of the present general inventive concept, there is provided a developing device detachable to a main body of an image forming apparatus, the device including: a photoconductor; a housing containing toner; and a developing roller installed in the housing and supplies the toner to an electrostatic latent image formed on the photoconductor, wherein the developing roller includes: a cylindrical unit in the form of a hollow pipe supported by the housing and including an inner side and an outer side, and a connection hole; and a power transmission unit power connected to the main body for rotating the developing roller, including a connection projection combined to the connection hole, and coupled to the inner side of the cylindrical unit by clearance fit.

The developing device may further include a bearing member interposed between the housing and both ends of the cylindrical unit for supporting one of the inner side and the outer side.

The image forming apparatus is an electrophotographic image forming apparatus that includes the developing device and prints an image to a recording medium.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION

The present general inventive concept will now be described more fully with reference to the accompanying drawings, in which exemplary embodiments of the present general inventive concept are shown.

Hereinafter, a developing device and an image forming apparatus according to embodiments of the present general inventive concept will be described in detail with reference to the accompanying drawings.

Figure 1:
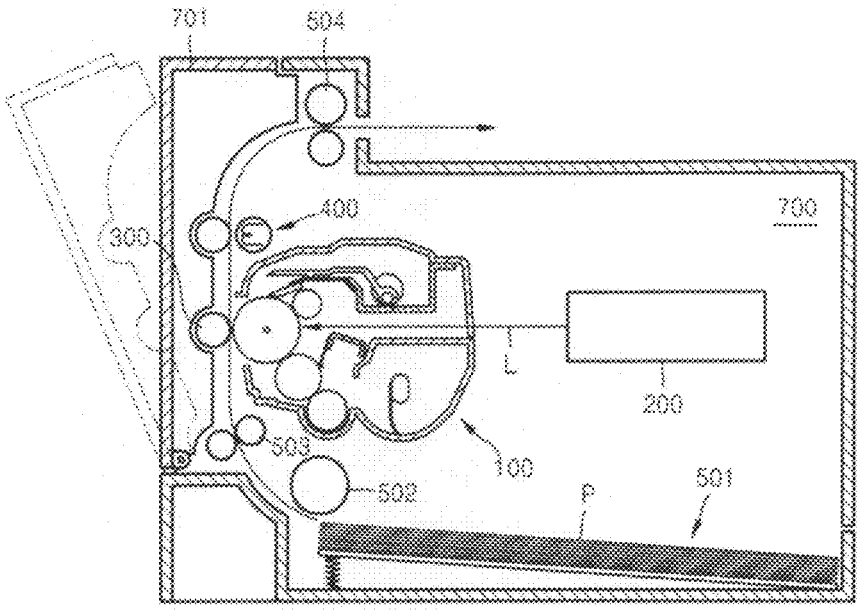
FIG. 1 illustrates an image forming apparatus according to an embodiment.
Figure 2:
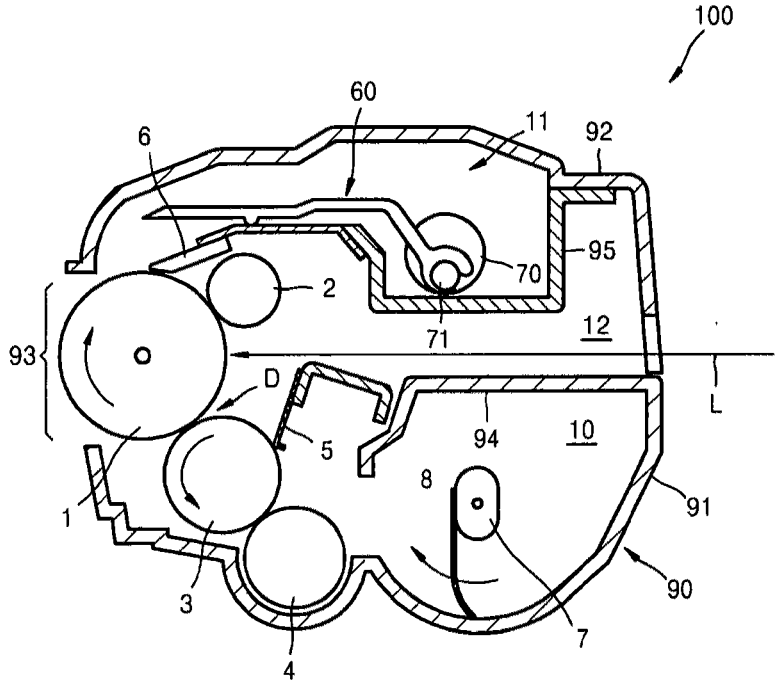
FIG. 2 illustrates a developing device according to an embodiment.

FIG. 1 illustrates an image forming apparatus according to an embodiment and FIG. 2 illustrates a developing device 100 according to an embodiment. The developing device 100 includes a photoconductive drum 1 and a developing roller 3.

Referring to FIG. 2, the photoconductive drum 1 is an example of a photoconductor, on which an electrostatic latent image is formed, and includes a photoconductive layer having optical conductivity on the circumference of a cylindrical metal pipe. A charging roller 2 is an example of a charger that charges a surface of the photoconductive drum 1 with uniform electric potential. A charging bias voltage is applied to the charging roller 2. A corona charger (not illustrated) may be used instead of the charging roller 2. The developing roller 3 supplies toner to an electrostatic latent image formed on the surface of the photoconductive drum 1 and develops the image. In the current embodiment, the surface of the developing roller 3 is spaced apart from the surface of the photoconductive drum 1 by an interval of about few hundreds micrometers. The interval is denoted as a developing gap D. When a developing bias voltage is applied to the developing roller 3, toner moves to the electrostatic latent image formed on the surface of the photoconductive drum 1 through the developing gap D and is attached to the developing roller 3.

The developing device 100 may further include a supply roller 4 for attaching toner to the developing roller 3. A supply bias voltage may be applied to the supply roller 4 for attaching toner to the developing roller 3. Reference numeral 5 is a regulator for regulating an amount of toner attached on the surface of the developing roller 3. The regulator 5 may be, for example, a regulating blade in which a front end thereof contacts the developing roller 3 by predetermined pressure. A cleaning member 6 removes remained toner or foreign substances from the surface of the photoconductive drum 1. The cleaning member 6 may be, for example, a cleaning blade, in which a front end thereof contacts the surface of the photoconductive drum 1. Hereinafter, foreign substances removed from the surface of the photoconductive drum 1 are denoted as waste toner.

The developing device 100 includes a toner container 10 and a waste toner container 11. The waste toner container 11 contains waste toner removed from the surface of the photoconductive drum 1. The toner container 10 contains toner. An agitator 7 is installed in the toner container 10. The agitator 7 transports toner to the developing roller 3. The agitator 7 may have a function of agitating toner and charging the toner with a predetermined electric potential. In FIG. 2, one agitator 7 is illustrated; however, the present general inventive concept is not limited thereto. An appropriate number of agitators 7 may be installed in an appropriate location of the toner container 10 for efficiently supplying toner to the developing roller 3 in consideration of capacity and form of the toner container 10. The agitator 7 may include an agitating wing on a rotation shaft in the form of one or a plurality of flexible film. Also, although not illustrated, the agitator 7 may be an auger including a spiral agitating wing. The agitator 7 transports toner to the developing roller 3, agitates the toner, and frictionally charges the toner.

A waste toner transporting member 60 may be installed in the waste toner container 11. The waste toner transporting member 60 is connected to an eccentric unit 71 disposed eccentrically from a rotation center of a rotating member 70. As the rotating member 70 rotates, the waste toner transporting member 60 moves back and forth and transports the waste toner removed from the photoconductive drum 1 to the inside of the waste toner container 11.

A housing 90 constitutes the toner container 10 and the waste toner container 11 and functions as a frame that supports elements forming the developing device 100 such as the photoconductive drum 1, the charging roller 2, the developing roller 3, the supply roller 4, and the agitator 7. The circumference of the photoconductive drum 1 is partially exposed to the outside of the housing through an opening 93. First and second partition walls 94 and 95 may be disposed in the housing 90. A lower frame 91 and the first partition wall 94 constitute the toner container 10 and an upper frame 92 and the second partition wall 95 constitute the waste toner container 11. The first partition wall 94 and the second partition wall 95 are spaced apart from each other and an optical path 12, to which light L scanned from an optical scanning unit 200 of FIG. 1 is incident, is formed so as to expose the photoconductive drum 1 between the first partition wall 94 and the second partition wall 95.

Referring to FIG. 1, the developing device 100 is installed in a main body 700 of the image forming apparatus through a door 701. When the developing device 100 is installed to the main body 700, a driving member (not illustrated) disposed in the main body 700 is connected to the developing device 100 and rotates elements forming the developing device 100 such as the photoconductive drum 1, the charging roller 2, the developing roller 3, the supply roller 4, and the agitator 7.

The optical scanning unit 200 scans light modulated according to image information to the surface of the photoconductive drum 1 charged with uniform electric potential. For example, a laser scanning unit (LSU) that directs light irradiated from a laser diode in a main scanning direction by using a polygon mirror and scans the light to the photoconductive drum 1 may be used as the optical scanning unit 200.

A transfer roller 300 is an example of a transfer unit that is disposed to face the surface of the photoconductive drum 1 and forms a transfer nip. A transfer bias voltage is applied to the transfer roller 300 for transferring a toner image developed on the surface of the photoconductive drum 1 to a recording medium P. A corona transfer unit may be used instead of the transfer roller 300.

The toner image transferred to the surface of the recording medium P by the transfer roller 300 maintains on the surface of the recording medium P by electrostatic attraction. A fixing unit 400 forms a permanent print image on the recording medium P by applying heat and pressure to the toner image and fixing the toner image to the recording medium P.

An image forming process will be briefly described. A charging bias voltage is applied to the charging roller 2 and the photoconductive drum 1 is charged with uniform electric potential. The optical scanning unit 200 scans light modulated in correspondence to image information to the photoconductive drum 1 through the optical path 12 disposed in the developing device 100 and forms an electrostatic latent image on the surface of the photoconductive drum 1. Toner transports to the supply roller 4 by the agitator 7 and the supply roller 4 attaches the toner to the surface of the developing roller 3. The regulator 5 forms a toner layer having uniform thickness on the developing roller 3. A developing bias voltage is applied to the developing roller 3. As the developing roller 3 rotates, toner transported to the transfer nip D moves and fixed to the electrostatic latent image formed on the surface of the photoconductive drum 1 by the developing bias voltage. Thus, a visible toner image is formed on the surface of the photoconductive drum 1. The recording medium. P drawn from a recording medium tray 501 by a pickup roller 502 moves to the transfer roller 300 and the transfer nip facing the photoconductive drum 1 by a transporting roller 503. When a transfer bias voltage is applied to the transfer roller 300, the toner image is transferred to the recording medium P by electrostatic attraction. The toner image transferred to the recording medium P is applied by heat and pressure from the fixing unit 400 and is fixed to the recording medium P, thereby completing printing. The recording medium P is discharged by a discharge roller 504. Toner that is not transferred to the recording medium P and is remained on the surface of the photoconductive drum 1 is removed by the cleaning member 6 and is contained in the waste toner container 11.

The developing roller 3 needs to be stably supported by the housing 90 and rotated. When a location of the developing roller 3 is changed, the developing gap D is changed and a location of the regulator 5 is relatively changed, thereby deteriorating image quality.

Figure 3:
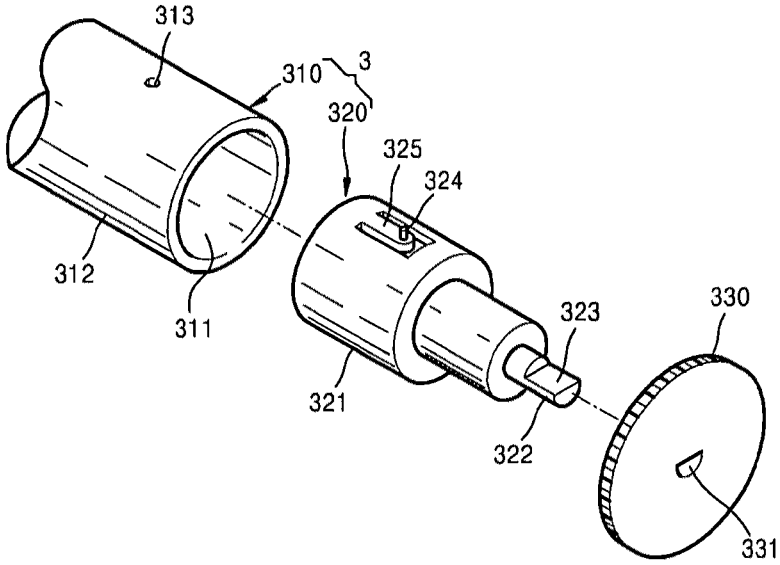
FIG. 3 is a perspective view of a developing roller.
Figure 4:
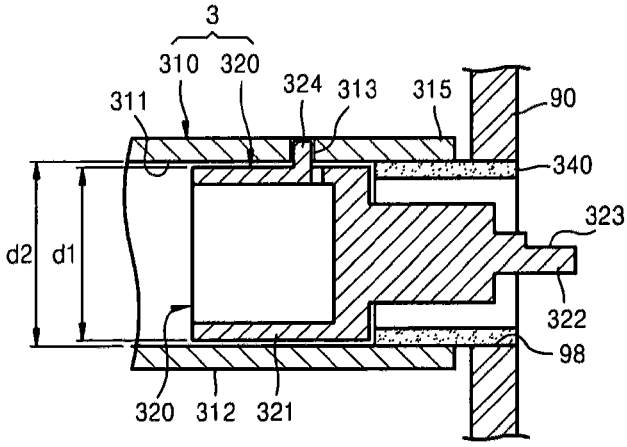
FIG. 4 is a cross-sectional view illustrating a structure for supporting a developing roller in a housing according to an embodiment.

FIG. 3 is a perspective view of the developing roller 3 and FIG. 4 is a cross-sectional view illustrating a structure for supporting the developing roller 3 in the housing 90 according to an embodiment of the present general inventive concept. Referring to FIG. 3, the developing roller 3 may include a cylindrical unit 310 in the form of a hollow pipe for attaching and applying toner to the photoconductive drum 1 and a power transmission unit 320 connected to one end of the cylindrical unit 310 for rotating the developing roller 3. A power transmission member for rotating the developing roller 3, for example, a gear 330, may be connected to the power transmission unit 320.

Figure 5:
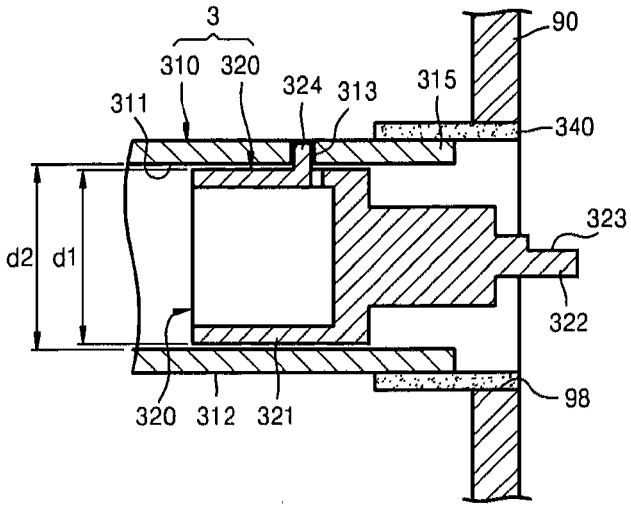
FIG. 5 is a cross-sectional view illustrating a structure for supporting a developing roller in a housing according to another embodiment.

When nonmagnetic one-component toner is used, the cylindrical unit 310 may be formed of a nonmagnetic metal, for example, aluminum. In some cases, an elastic layer may be disposed on the circumference of the cylindrical unit 310. The cylindrical unit 310 includes an inner side 311 and an outer side 312. The cylindrical unit 310 is supported by the housing 90. For example, the cylindrical unit 310 may be supported by a sidewall of the lower frame 91 of FIG. 2. As illustrated in FIG. 4, a bearing member 340 may be interposed between the cylindrical unit 310 and the housing 90 in order for the cylindrical unit 310 to be smoothly rotated with respect to the housing 90. For example, the bearing member 340 may support the inner side 311 of the cylindrical unit 310. Also, as illustrated in FIG. 5, the bearing member 340 may support the outer side 312 of the bearing member 340. The bearing member 340 is fixed to the housing 90 so as to not be rotated and the inner side 311 or the outer side 312 of the cylindrical unit 310 slidably contacts the bearing member 340 and rotates. The bearing member 340 may be manufactured by an injection molding process using engineering plastic having excellent abrasion resistance, for example, polyacetal resin such as polyoxymethylene (pom). Also, the bearing member 340 may be formed using sintered ceramic or sintered metal containing oil. In FIGS. 4 and 5, one end 315 of the cylindrical unit 310 is supported by the housing 90. However, the other end of the cylindrical unit 310 that is not illustrated is also supported by the housing 90.

The power transmission unit 320 is coupled to the cylindrical unit 310 by clearance fit. For example, referring to FIGS. 3 and 4, the power transmission unit 320 includes an insertion unit 321 inserted to the inner side 311 of the cylindrical unit 310. A diameter d1 of the insertion unit 321 is smaller than a diameter d2 of the inner side 311. The difference between the diameter d1 of the insertion unit 321 and the diameter d2 of the inner side 311 may be maintained so that the insertion unit 321 is not tightly inserted to the inner side 311 and is naturally inserted into the inner side 311. An extension unit 322 extended to the outside from the insertion unit 321 includes a gear combining unit 323 to which the gear 330 is combined. The gear combining unit 323 may be, for example, in the form of d-cut. An insertion hole 331 having a complementary shape with the gear combining unit 323 may be disposed on the gear 330. The gear 330 may be pressed in the gear combining unit 323 and although not illustrated, a connection member such as e-ring (not illustrated) or a washer may be combined to the extension unit 322 so that the gear 330 is not separated from the gear combining unit 323.

When the gear 330 rotates and thus the power transmission unit 320 rotates, the cylindrical unit 310 may include a connection hole 313 so that the cylindrical unit 310 also rotates. The insertion unit 321 may include a connection projection 324 that is combined to the connection hole 313. The connection projection 324 may be disposed on, for example, an end of a flexible arm 325. Since the flexible arm 325 moves backward in a radial direction when the insertion unit 321 is inserted into the inner side 311, and the flexible arm 325 returns to its original location when the connection projection 324 and the connection hole 313 are arranged, the connection projection 324 is inserted into the connection hole 313. Then, the power transmission unit 320 is fixed to an axial direction of the power transmission unit 320 and thus is not separated from the cylindrical unit 310. Also, when the power transmission unit 320 rotates, the cylindrical unit 310 also rotates due to combination of the connection projection 324 and the connection hole 313.

Figure 6:
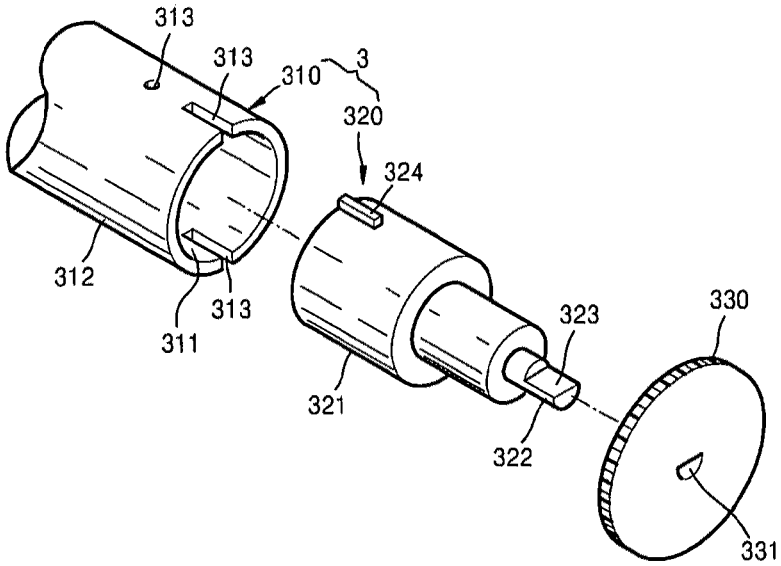
FIG. 6 is an exploded perspective view illustrating a connection groove and a connection projection.

In FIGS. 3 through 5, one connection hole 313 and one connection projection 324 are illustrated. However, if necessary, two or more connection hole 313 and connection projection 324 may be disposed. In FIGS. 3 through 5, the connection hole 313 and the connection projection 324 matched to the connection hole 313 are illustrated. However, the shapes of the connection hole 313 and the connection projection 324 are not limited thereto. For example, as illustrated in FIG. 6, the connection hole 313 may be in the form of a slot extended in an axial direction from the end of the cylindrical unit 310. In this case, the connection projection 324 may not be disposed on the flexible arm 325 and is projected from the circumference of the insertion unit 321. In addition, the connection hole 313 and the connection projection 324 may have various forms so that the cylindrical unit 310 and the power transmission unit 320 may also rotate.

In order for the developing roller 3 to be stably supported by the housing 90, radius of curvature of the developing roller 3 supported by the housing 90 may be great as possible. A force in a radial direction is applied to the housing 90 through the developing roller 3 while a rotating force is transmitted to the developing roller 3 through the gear 330. Here, as a supporting surface 98 of FIGS. 4 and 5 of the housing 90, that is, a portion supporting the developing roller 3, increases, a force in a radial direction may be easily distributed so that deformation of the housing 90 may be reduced. A diameter of the power transmission unit 320 is generally smaller than the cylindrical unit 310. In this regard, the cylindrical unit 310 of the developing roller 3 is supported by the housing 90 and thus the developing roller 3 may be stably supported by the housing 90.

When the power transmission unit 320 is integrally formed with the cylindrical unit 310 as a single body (in this case, the cylindrical unit 310 is in a shaft form instead of a hollow form), diameters of the cylindrical unit 310 and the extension unit 322 are generally different from each other and thus rotation centers of the cylindrical unit 310 and the extension unit 322 may not be matched while being manufactured. In such a developing roller 3, the extension unit 322 is generally supported by the housing 90. In this case, the rotation centers are not matched and thus the developing gap D is changed according to a rotation cycle of the developing roller 3. A change of the developing gap D affects an amount of toner developed to the photoconductive drum 1 from the developing roller 3. Also, assembling locations of the regulator 5 and the developing roller 3 are changed according to a rotation cycle of the developing roller 3. When the assembling locations of the regulator 5 and the developing roller 3 are changed, a thickness of the toner layer formed on the circumference of the developing roller 3 is changed and thus an amount of toner supplied to the developing gap D is changed. The circumferential surfaces of the photoconductive drum 1 and the developing roller 3 facing the regulator 5 are periodically changed and thus an amount of toner developed to the photoconductive drum 1 is periodically changed. Thus, density of a printed image may be periodically uneven. The periodical changes of image quality may also occur when the power transmission unit 320 is coupled to the cylindrical unit 310 by interference fit.

In the developing device 100 according to the current embodiment, the cylindrical unit 310 is supported by the housing 90 and thus a rotation center of the cylindrical unit 310 is not changed. Accordingly, the degree of image quality affected by mismatch of the rotation centers of the power transmission unit 320 and the cylindrical unit 310 is reduced and thus stable image quality may be realized.

When the power transmission unit 320 is coupled to the cylindrical unit 310 by interference fit and the rotation centers of the power transmission unit 320 and the cylindrical unit 310 are not matched, a force in a radial direction is applied to the developing roller 3 while the developing roller 3 rotates and the housing 90 may be deformed due to the force. Since the housing 90 is deformed, a location of the developing roller 3 may be changed. Also, power connection between the gear 330 and driving members of the main body 700 is not well accomplished and thus a driving load may increase or driving noise may be generated.

In the developing device 100 according to the current embodiment, since the power transmission unit 320 is coupled to the cylindrical unit 310 by clearance fit and the cylindrical unit 310 is supported by the housing 90, the power transmission unit 320 may move in a radial direction to some degree. Accordingly, although the rotation centers of the power transmission unit 320 and the cylindrical unit 310 are not matched, the interference fit may similarly function as a universal joint and thus a rotating force of the power transmission unit 320 is well transmitted to the cylindrical unit 310. Thus, the developing roller 3 may be stably rotated. Also, power connection between the gear 330 and the driving members of the main body 700 is well accomplished and thus an increase in a driving load or driving noise may be prevented.

According to the embodiments of the present general inventive concept, a single-colored image forming apparatus including one developing device 100 is illustrated. However, the present general inventive concept is not limited thereto. In a colored image forming apparatus, four developing devices 100 containing, for example, cyan (c), magenta (m), yellow (y), and black (k) toners, may be used.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A developing device comprising:

a housing containing toner;

a developing roller installed in the housing that supplies the toner to an electrostatic latent image formed on a photoconductor, the developing roller comprises a cylindrical unit in the form of a hollow pipe, and a power transmission unit connected to one end of the cylindrical unit and connected to a power transmission member to rotate the developing roller; and a bearing member interposed between the housing and the cylindrical unit of the developing roller, wherein the cylindrical unit is supported by the housing via the bearing member whereby the power transmission unit is not restricted by the housing.

2. The developing device of claim 1, wherein one end of the cylindrical unit comprises a connection hole, and the power transmission unit comprises an insertion unit having a diameter smaller than a diameter of an inner side of the cylindrical unit and inserted into the inner side, an extension unit extended from the insertion unit and combined with the power transmission member, and a connection projection inserted into the connection hole so that the power transmission unit rotates with the cylindrical unit.

3. The developing device of claim 1, wherein the bearing member supports the inner side of the cylindrical unit.

4. The developing device of claim 1, wherein the bearing member supports an outer side of the cylindrical unit.

5. An electrophotographic image forming apparatus comprising the developing device of claim 1 and printing an image to a recording medium.

6. The electrophotographic image forming apparatus of claim 5, wherein the power transmission unit is coupled to the inner side of the cylindrical unit by clearance fit.

7. The electrophotographic image forming apparatus of claim 6, wherein one end of the cylindrical unit comprises a connection hole, and the power transmission unit comprises an insertion unit having a diameter smaller than a diameter of an inner side of the cylindrical unit and inserted into the inner side, an extension unit extended from the insertion unit and combined with a power transmission member, and a connection projection inserted into the connection hole so that the power transmission unit rotates with the cylindrical unit.

8. The electrophotographic image forming apparatus of claim 7, wherein the extension unit includes a gear combining unit to which a gear is combined, the gear connecting the extension unit to the power transmission member.

9. The electrophotographic image forming apparatus of claim 6, wherein the bearing member supports the inner side of the cylindrical unit.

10. The electrophotographic image forming apparatus of claim 6, wherein the bearing member supports an outer side of the cylindrical unit.

11. A developing device detachable to a main body of an image forming apparatus, the device comprising:

a photoconductor;

a housing containing toner; and a developing roller installed in the housing and supplies the toner to an electrostatic latent image formed on the photoconductor, wherein the developing roller comprises a cylindrical unit in the form of a hollow pipe supported by the housing and comprising an inner side and an outer side, and a connection hole; and a power transmission unit power connected to the main body for rotating the developing roller, comprising a connection projection combined to the connection hole, and coupled to the inner side of the cylindrical unit by clearance fit.

12. The developing device of claim 11, further comprising a bearing member interposed between the housing and both ends of the cylindrical unit for supporting one of the inner side and the outer side.

* * * * *

UNITED STATES PATENT AND TRADEMARK OFFICE

CERTIFICATE OF CORRECTION

PATENT NO. : 8,831,474 B2
APPLICATION NO. : 13/067516
DATED : September 9, 2014
INVENTOR(S) : Jong-hwa Joo et al.

It is certified that error appears in the above-identified patent and that said Letters Patent is hereby corrected as shown below:

On the Title Page, Column 2, Item [57] (Abstract), line 10-12, After "housing." Delete "Both ends of the cylindrical unit are supported by the housing and the power transmission unit is not restricted by the housing.".

Signed and Sealed this
Twenty-third Day of December, 2014

Michelle K. Lee

Michelle K. Lee
*Deputy Director of the United States Patent and Trademark Office*